US006513606B1

(12) United States Patent
Krueger

(10) Patent No.: US 6,513,606 B1
(45) Date of Patent: Feb. 4, 2003

(54) SELF-CONTROLLED DIRECTIONAL DRILLING SYSTEMS AND METHODS

(75) Inventor: Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/438,013

(22) Filed: Nov. 10, 1999

Related U.S. Application Data

(60) Provisional application No. 60/107,856, filed on Nov. 10, 1998.

(51) Int. Cl.[7] ..... E21B 4/02; E21B 7/08; E21B 44/00; E21B 47/024

(52) U.S. Cl. ..... 175/61; 166/255.1; 175/45; 175/26; 175/76; 175/107

(58) Field of Search ..... 166/255.1, 255.2, 166/313, 50, 117.5, 241.6, 241.4; 175/45, 61, 107, 26, 325.1, 325.5, 73, 76

(56) References Cited

U.S. PATENT DOCUMENTS

| | | | | | |
|---|---|---|---|---|---|
| 5,220,963 | A | * | 6/1993 | Patton | 175/24 |
| 5,332,048 | A | | 7/1994 | Underwood et al. | 175/26 |
| 5,341,886 | A | * | 8/1994 | Patton | 175/24 |
| 5,603,386 | A | * | 2/1997 | Webster | 175/76 |
| 6,092,610 | A | * | 7/2000 | Kosmala et al. | 175/61 |

FOREIGN PATENT DOCUMENTS

WO WO 98/17894 4/1998

OTHER PUBLICATIONS

Patton, "Automatic Directional Drilling Shows Promise", Petroleum Engr Int'l 64 (Apr. 1992) pp. 44–48.

* cited by examiner

*Primary Examiner*—David Bagnell
*Assistant Examiner*—Jennifer H Gay
(74) *Attorney, Agent, or Firm*—Madan, Mossman & Sriram, P.C.

(57) ABSTRACT

The present invention provides a drilling assembly that includes a mud motor that rotates a drill bit and a set of independently expandable ribs. A stabilizer uphole of the ribs provides stability. A second set of ribs may be disposed on the drilling assembly. Vertical and curved holes are drilled by rotating the drill bit by the mud motor and by independently adjusting the rib forces. The drill string is not rotated. Inclined straight sections and curved sections may be drilled by independent adjustment of the rib forces and by rotating the drill bit with the motor, without rotating the drill string. Inclined sections or curved sections in the vertical plane are drilled by superimposing the drillstring rotation on the mud motor rotation and by setting the rib forces to the same predetermined values. Rib forces are adjusted if the drilling direction differs from the defined inclination. The system is self-adjusting and operates in a closed loop manner. Inclination and navigation sensor data are processed by a downhole controller. The force vectors may be programmed in the downhole controller. Command signals from a surface controller may be sent to initiate the setting and/or adjustment of the rib forces or the rib force vector.

34 Claims, 3 Drawing Sheets

SELF-CONTROLLED DIRECTIONAL DRILLING SYSTEMS AND METHODS

CROSS REFERENCE TO RELATED APPLICATIONS

This application claims the benefit of priority from U.S. Provisional Application Ser. No. 60/107,856, filed Nov. 10, 1998.

BACKGROUND OF THE INVENTION

1. Field of the Invention

This invention relates generally to drill strings for drilling directional wellbores and more particularly to a self-adjusting steerable drilling system and method for drilling directional wellbores.

2. Description of the Related Art

Steerable motors comprising a drilling or mud motor with a fixed bend in a housing thereof that creates a side force on the drill bit and one or more stabilizers to position and guide the drill bit in the borehole are generally considered to be the first systems to allow predicable directional drilling. However, the compound drilling path is sometimes not smooth enough to avoid problems with the completion of the well. Also, rotating the bent assembly produces an undulated well with changing diameter, which can lead to a rough well profile and hole spiraling which subsequently might require time consuming reaming operations. Another limitation with the steerable motors is the need to stop rotation for the directional drilling section of the wellbore, which can result in poor hole cleaning and a higher equivalent circulating density at the wellbore bottom. Also, this increases the frictional forces which makes it more difficult to move the drill bit forward or downhole. It also makes the control of the tool face orientation of the motor more difficult.

The above-noted problems with the steerable drilling motor assemblies lead to the development of so called "self-controlled" or drilling systems. Such systems generally have some capability to follow a planned or predetermined drilling path and to correct for deviations from the planned path. Such self-controlled system are briefly described below. Such systems, however, enable faster, and to varying degree, a more direct and tailored response to potential deviation for directional drilling. Such systems can change the directional behavior downhole, which reduces the dog leg severity .

The so called "straight hole drilling device" ("SDD") is often used in drilling vertical holes. An SDD typically includes a straight drilling motor with a plurality of steering ribs, usually two opposite ribs each in orthogonal planes on a bearing assembly near the drill bit. Deviations from the vertical are measured by two orthogonally mounted inclination sensors. Either one or two ribs are actuated to direct the drill bit back onto the vertical course. Valves and electronics to control the actuation of the ribs are usually mounted above the drilling motor. Mud pulse or other telemetry systems are used to transmit inclination signals to the surface. The lateral deviation of boreholes from the planned course (radial displacement) achieved with such SDD systems has been nearly two orders of magnitude smaller than with the conventional assemblies. SDD systems have been used to form narrow cluster boreholes and because less tortuous boreholes are drilled by such a system, it reduces or eliminates the reaming requirements.

In the SDD systems, the drill string is not rotated, which significantly reduces the hole breakout. The advantage of drilling vertical holes with SDD systems include: (a) a less tortuous well profile; (b) less torque and drag; (c) a higher rate of penetration; (d) less material (such as fluid) consumption; (e) less environmental impact; (f) a reduced risk of stuck pipe; (g) less casing wear, and (h) less wear and damage to drilling tubulars.

An automated drilling system developed by Baker Hughes Incorporated, the assignee of this application, includes three hydraulically-operated stabilizer ribs mounted on a non-rotating sleeve close to the drill bit. The forces applied to the individual ribs are individually controlled creating a force vector. The amount and direction of the side force are kept constant independent of a potential undesired rotation of.the carrier sleeve. The force vector can be pre-programmed before running into the borehole or changed during the drilling process with commands from the surface.

This system has two basic modes of operation: (i) steer mode and (ii) hold mode. In the steer mode the steering force vector is preprogrammed or reset from the surface, thus allowing to navigate the well path. In the "hold mode" values for inclination and/or azimuth are preset or adjusted via surface-to-downhole communications, thus allowing changes to the borehole direction until the target values are achieved and then keeping the well on the target course. As the amount of side force is preset, the turn radius or the equivalent build-up rate (BUR) can be smoothly adjusted to the requirements from 0 to the maximum value of 8°/100 feet for such a system.

An automated directional drilling bottomhole assembly developed by Baker Hughes Incorporated and referred to as AUTOTRAK has integrated formation evaluation sensors to not only allow steering to solely directional parameters, but to also take reservoir changes into account and to guide the drill bit accordingly. AUTOTRAK may be used with or without a drilling motor. Using a motor to drive the entire assembly allows a broader selection of bits and maximizes the power to the bit. With a motor application, the string rpm becomes an independent parameter. It can be optimized for sufficient hole cleaning, the least casing wear and to minimize dynamics and vibrations of the BHA, which heavily depend on the rotational string frequency.

One of the more recent development of an automated drilling system is an assembly for directional drilling on coiled tubing. This system combines several features of the SDD and the AUTOTRAK system for coiled tubing applications. This coiled tubing system allows drilling of a well path in three dimensions with the capability of a downhole adjustable BUR. The steering ribs are integrated into the bearing assembly of the drilling motor. Other steering features have been adopted from the AUTOTRAK with the exception that the steering control loop is closed via the surface rather than downhole. The fast bi-directional communication via the cable inside the coil provides new opportunities for the execution of well path corrections. With the high computing power available at the surface, formation evaluation measurements can be faster processed and converted into a geosteering information and imported into the software for the optimization of directional drilling.

A coiled tubing automated drilling system is disclosed in the U.S. Ser. No. 09/015,848, assigned to the assignee of this application, the disclosure of which is incorporated herein by reference.

The steering-while-rotating drilling systems can be further enhanced through a closed loop geosteering by using the formation evaluation measurements to directly correct the deviations of the course from the planned path. A true navigation can become possible with the integration of gyro systems that withstand drilling conditions and provide the required accuracy. With further automation, the manual intervention can be reduced or totally eliminated, leaving the need to only supervise the drilling process. Both supervision and any necessary intervention can then be done from remote locations via telephone lines or satellite communication.

The trend in the oil and gas industry is to drill extended reach wells having complex well profiles. Such boreholes may have an upper vertical section extending from the surface to a predetermined depth and one or more portions thereafter which may include combinations of curved and straight sections. For efficient and proper hole forming, it is important to utilize a drill string that has full 3-D steering capability for curved sections and is also able to drill straight sections fast which are not rough or spiraled.

The present invention addresses the above-noted problems and provides a drilling system that is more effective than the currently available or known systems for drilling a variety of directional wellbores.

SUMMARY OF THE INVENTION

The present invention provides a drilling system for drilling deviated wellbores. The drilling assembly of the system contains a drill bit at the lower end of the drilling assembly. A motor provides the rotary power to the drill bit. A bearing assembly disposed between the motor and the drill bit provides lateral and axial support to the drill shaft connected to the drill bit. A steering device provides directional control during the drilling of the wellbores. The steering device contains a plurality of ribs disposed at an outer surface of the drilling assembly. Each rib is independently controlled and moves between a normal or collapsed position and a radially extended position. Each rib may exert force on the wellbore interior when urged against the wellbore. Power units to independently control the rib actions are disposed in the drilling assembly. A controller carried by the drilling assembly controls the operation of the power units in response to directional and navigational sensors in the drilling assembly. Sensors to determine the amount of the force applied by each rib on the wellbore may be provided. A second set of ribs axially spaced apart from the first set, is preferably provided. This allows the drilling of a greater range of curved holes and better control over straight hole drilling.

The curved holes are drilled by rotating the drill bit by the mud motor and by independently adjusting the rib forces. The drill string is kept stationary. Vertical sections are drilled in a similar way. To compensate for a deviation from the vertical, selected forces can be individually applied to the ribs in order to generate a force vector in the plane orthogonal to the borehole axis. It is also possible to apply the same force or no force to the ribs and even rotate the drill string. Straight inclined sections can be drilled without string rotation with a proper force adjustment on the steering ribs to accomplish straight drilling. To reduce the friction while longitudinally moving the drilling assembly, to improve the hole cleaning and the cuttings transport, and to deliver more power to the bit, the drill string can be continuously rotated at any speed required while drilling straight inclined sections. To control the drilling direction in the vertical plane while rotating the string, the same force is applied to all of the ribs. The magnitude of this force is selected such that the required directional tendency is achieved.

Force vectors or the magnitude of the forces are adjusted if the drilling direction differs from the defined course. The system is self-adjusting and operates in a closed loop manner. Inclination and navigation sensor data is processed by a downhole controller. The force vectors may be programmed in the downhole controller. Command signals from a surface controller may be sent to initiate the setting and/or adjustment of the rib force vectors in accordance with the planned wellbore course (path).

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENTS

The present invention provides a self-controlled drilling system and methods for efficiently and effectively drilling vertical, three dimensional curved and inclined straight sections of a wellbore. The operation of the drilling system may be, to any degree, preprogrammed for drilling one or more sections of the wellbore and/or controlled from the well surface or any other remote location.

Figure 1A:
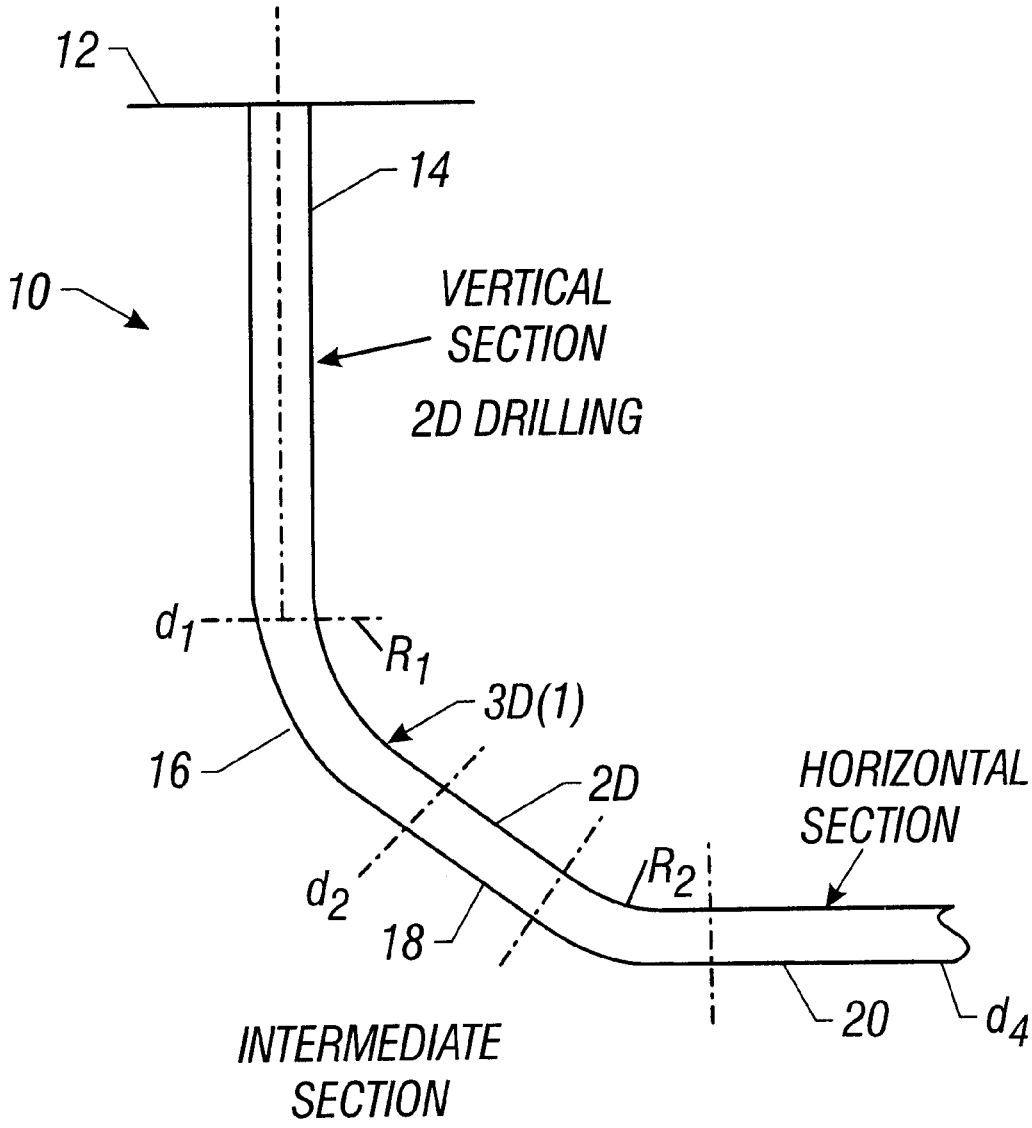
FIGS. 1A–1B show examples of well profiles that are contemplated to be drilled according to the systems of the present invention.
Figure 1B:
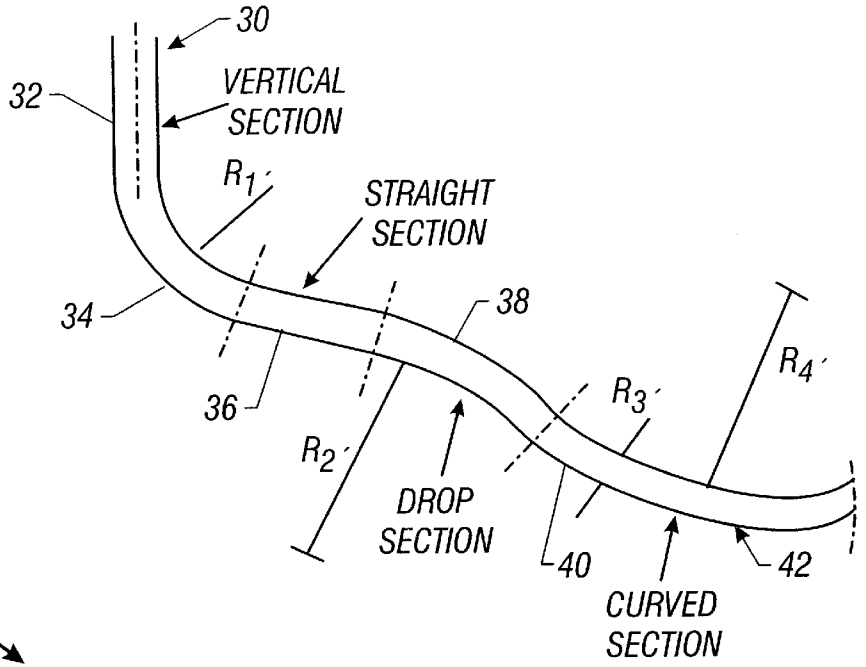

FIGS. 1A–1B show examples of certain wellbores which can be efficiently and effectively drilled by the drilling systems of the present invention. The drilling system is described in reference to FIGS. 2–3.

FIG. 1A shows a wellbore profile 10 that includes a vertical section 14 extending from the surface 12 to a depth d1. The wellbore 10 then has a first curved section 16 having a radius R1 and extends to the depth d2. The curved section 16 is followed by an intermediate section 18 which is a straight section that extends to the depth d3. The wellbore 10 then has a second curved section with a radius R2 that may be different (greater or lesser) from the first radius R1. The wellbore 10 is then shown to have a horizontal section 20 that extends to a depth d4 or beyond. The term "depth" as used herein means the reach of the well from the surface, and may not be the true vertical depth from the surface. The terms "3D" and "2D" refer to the three-dimensional or two-dimensional nature of the drilling geometry.

FIG. 1B shows a well profile 30, wherein the well has a vertical section 32 followed by a curved section 34 of radius R1', an inclined section 36 and then a second curved section 38 that is curved downward (dropping curved) with a radius R2'. The well then has a curved build-up section 40 with a radius R3' and section 42 with a radius R4'.

Figure 2:
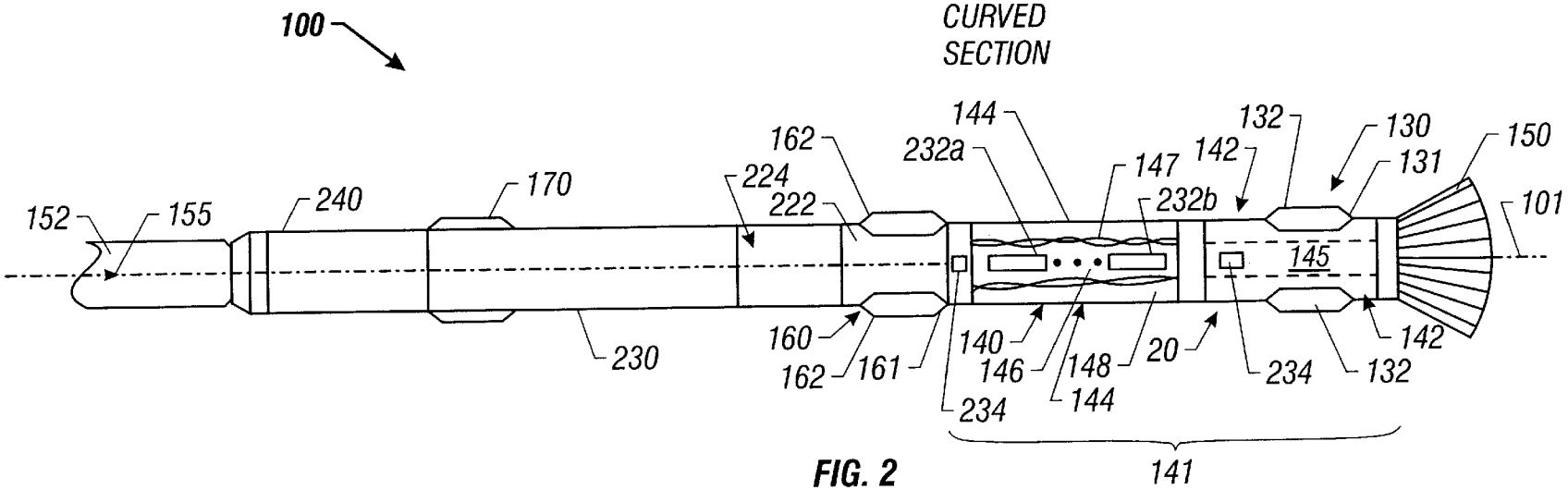
FIG. 2 shows a schematic of a drilling assembly made according to one embodiment of the present invention for drilling the wellbores of the type shown in FIGS. 1A–1B.

The number of the wellbores having well profiles of the type shown in FIG. 1A–1B is expected to continue to increase. FIG. 2 shows a schematic diagram of a drilling assembly 100 according to one embodiment of the present invention for drilling the above-described wellbores. The drilling assembly 100 carries a drill bit 150 at its bottom or the downhole end for drilling the wellbore and is attached to a drill pipe 152 at its uphole or top end. A drilling fluid 155 is supplied under pressure from the surface through the drill pipe 152. A mud motor or drilling motor 140 above or uphole of the drill bit 150 includes a bearing section 142 and a power section 144. The drilling motor 140 is preferably a positive displacement motor, which is well known in the art. A turbine may also be used. The power section includes a rotor 146 disposed in a stator 148 forming progressive cavities 147 there between. Fluid 155 supplied under pressure to the motor 140 passes through the cavities 147 driving or rotating the rotor 146, the rotor 146 in turn is connected to the drill bit 150 via a drill shaft 145 in the bearing section 142 that rotates the drill bit 150. A positive displacement drilling motor is described in the Patent application Ser. No. 09/015,848, assigned to the assignee of the application, the disclosure of which is incorporated herein by reference in its entirety. The bearing section 142 includes bearings which provides axial and radial stability to the drill shaft.

The bearing section or assembly 142 above the drill bit 150 carries a first steering device 130 which contains a number of expandable ribs 132 that are independently controlled to exert desired force on the wellbore inside and thus the drill bit 150 during drilling of the borehole. Each rib 132 can be adjusted to any position between a collapsed position, as shown in FIG. 2, and a fully extended position, extending outward or radially from the longitudinal axis 101 of the drilling assembly 100 to apply the desired force vector to the wellbore. A second steering device 160 is preferably disposed a suitable distance uphole of the first steering device 130. The spacing of the two rib devices will depend upon the particular design of the drilling assembly 100. The steering device 160 also includes a plurality of independently controlled ribs 162. The force applied to the ribs 162 may be different from that applied to the ribs 132. In one embodiment, the steering device 160 is disposed above the mud motor 140. A fixed stabilizer 170 is disposed uphole of the second steering device 160. In one embodiment, the stabilizer 170 is disposed near the upper end of the drilling assembly 100. In the drilling assembly configuration 100, the drill bit 150 may be rotated by the drilling motor 140 and/or by rotating the drill pipe 152. Thus, the drill pipe rotation may be superimposed on the drilling motor rotation for rotating the drill bit 150. The steering devices 130 and 160 each have at least three ribs for adequate control of the steering direction at each such device location. The ribs may be extended by any suitable method, such as a hydraulic system driven by the drilling motor that utilizes the drilling fluid 155 or by a hydraulic system that utilizes sealed fluid in the drilling assembly 100 or by an electro-hydraulic system wherein a motor drives the hydraulic system or an electromechanical system wherein a motor drives the ribs. Any suitable mechanism for operating the ribs may be utilized for the purpose of this invention. One or more sensors 131 may be provided to measure the displacement of and/or the force applied by each rib 132 while sensors 161 measure the displacement of and/or the force applied by the ribs 162. U.S. patent application Ser. No. 09/015,848 describes certain mechanisms for operating the ribs and determining the force applied by such ribs, which is incorporated herein by reference. U.S. Pat. No. 5,168,941 also discloses a method of operating expandable ribs, the disclosure of which is incorporated herein by reference.

A set of, preferably three orthogonally mounted inclinometers 234 determines the inclination of the drilling assembly 100. The drilling assembly 100 preferably includes navigation devices 222, such as gyro devices, magnetometer, inclinometers or either suitable combinations, to provide information about parameters that may be utilized downhole or at the surface to control the drilling direction. Sensors 222 and 234 may be placed at any desired location in the drilling assembly 100. This allows for true navigation of the drilling assembly 100 while drilling. A number of additional sensors (not shown), may be disposed in a motor assembly housing 141 or at any other suitable place in the assembly 100. The sensors may include a resistivity sensor, a gamma ray detector, and sensors for determining borehole parameters such as temperature and pressure, and drilling motor parameters such as the fluid flow rate through the drilling motor 140, pressure drop across the drilling motor 140, torque on the drilling motor 140 and the rotational speed (r.p.m.) of the motor 140.

The drilling assembly 100 may also include any number of additional sensors 224 known as the measurement-while-drilling devices or logging-while-drilling devices for determining various borehole and formation parameters or formation evaluation parameters, such as resistivity, porosity of the formations, density of the formation, and bed boundary information.

A controller 230 that includes one or more microprocessors or micro-controllers, memory devices and required electronic circuitry is provided in the drilling assembly. The controller receives the signals from the various downhole sensors, determines the values of the desired parameters based on the algorithms and models provided to the controller and in response thereto controls the various downhole devices, including the force vectors generated by the steering devices 130 and 160. The wellbore profile may be stored in the memory of the controller 230. The controller may be programmed to cause the drilling assembly to adjust the steering devices to drill the wellbore along the desired profile. Commands from the surface or a remote location may be provided to the controller 230 via a two-way telemetry 240. Data and signals from the controller 230 are transmitted to the surface via the telemetry 240.

Figure 3:
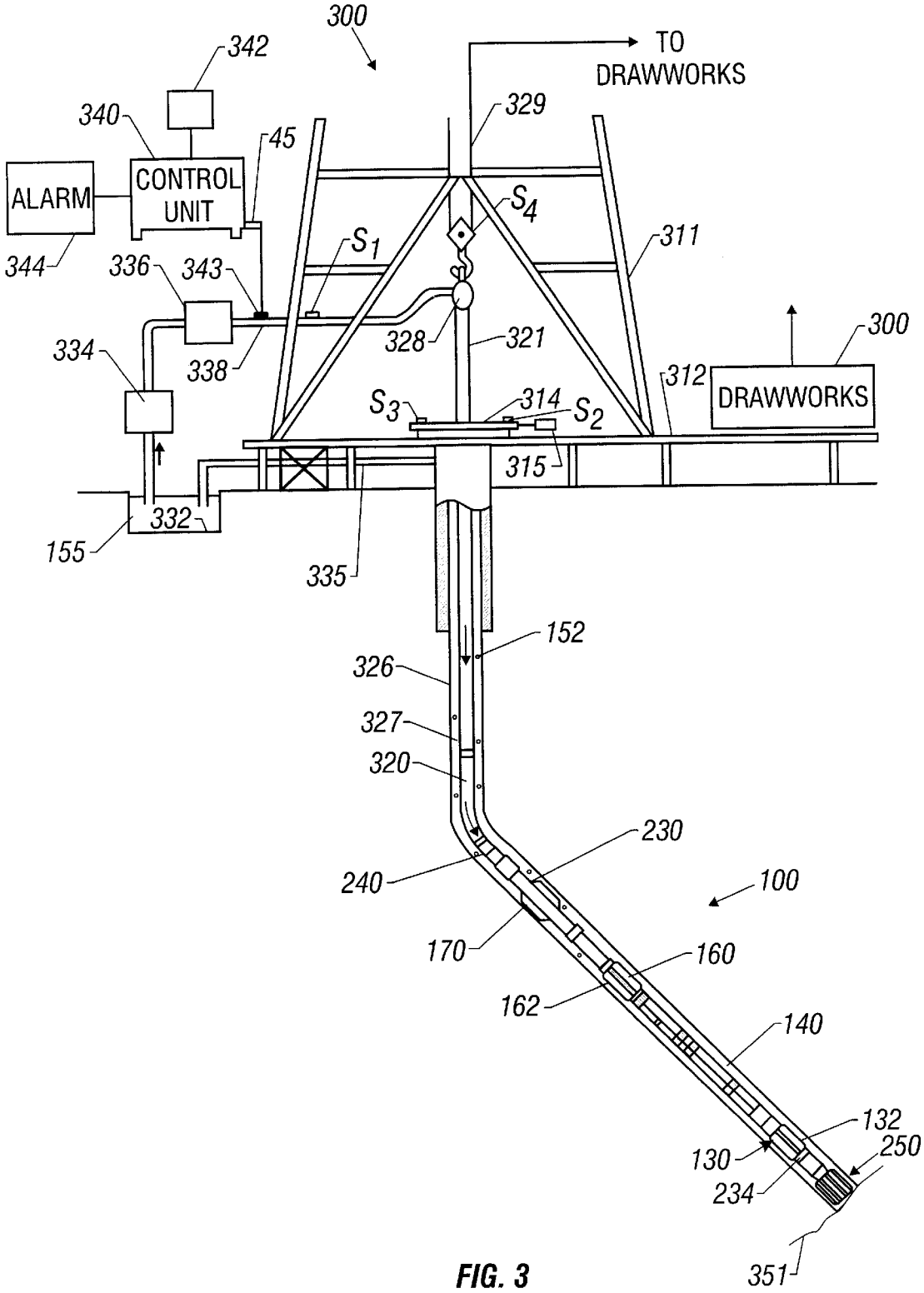
FIG. 3 is a schematic view of a drilling system utilizing the drilling assembly of FIG. 2 for drilling wellbores of the types shown in FIGS. 1A–1B.

FIG. 3 shows an embodiment of a land-based drilling system utilizing the drilling assembly 100 made according to the present invention to drill wellbores according to the present invention. These concepts and the methods are equally applicable to offshore drilling systems or systems utilizing different types of rigs. The system 300 shown in FIG. 3 has a drilling assembly 100 described above (FIG. 1) conveyed in a borehole 326. The drilling system 300 includes a derrick 311 erected on a floor 312 that supports a rotary table 314 which is rotated by a prime mover such as an electric motor 315 at a desired rotational speed. The drill string 320 includes the drill pipe 152 extending downward from the rotary table 314 into the borehole 326. The drill bit 150, attached to the drill string end, disintegrates the geological formations when it is rotated to drill the borehole 326. The drill string 320 is coupled to a drawworks 330 via a kelly joint 321, swivel 328 and line 329 through a pulley (not shown). During the drilling operation the drawworks 330 is operated to control the weight on bit, which is an important parameter that affects the rate of penetration. The operation of the drawworks 330 is well known in the art and is thus not described in detail herein.

During drilling operations, a suitable drilling fluid 155 from a mud pit (source) 332 is circulated under pressure through the drill string 320 by a mud pump 334. The drilling fluid 155 passes from the mud pump 334 into the drill string 320 via a desurger 336, fluid line 338 and the kelly joint 321. The drilling fluid 155 is discharged at the borehole bottom 351 through an opening in the drill bit 150. The drilling fluid 155 circulates uphole through the annular space 327 between the drill string 320 and the borehole 326 and returns to the mud pit 332 via a return line 335. A sensor $S_1$ preferably placed in the line 338 provides information about the fluid flow rate. A surface torque sensor $S_2$ and a sensor $S_3$ associated with the drill string 320 respectively provide information about the torque and the rotational speed of the drill string. Additionally, a sensor $S_4$ associated with line 329 is used to provide the hook load of the drill string 320.

In the present system, the drill bit 150 may be rotated by only rotating the mud motor 140 or the rotation of the drill pipe 152 may be superimposed on the mud motor rotation. Mud motor usually provides greater rpm than the drill pipe rotation. The rate of penetration (ROP) of the drill bit 150 into the borehole 326 for a given formation and a drilling assembly largely depends upon the weight on bit and the drill bit rpm.

A surface controller 340 receives signals from the downhole sensors and devices via a sensor 343 placed in the fluid line 338 and signals from sensors $S_1$, $S_2$, $5_3$, hook load sensor $S_4$ and any other sensors used in the system and processes such signals according to programmed instructions provided to the surface controller 340. The surface controller 340 displays desired drilling parameters and other information on a display/monitor 342 and is utilized by an operator to control the drilling operations. The surface controller 340 contains a computer, memory for storing data, recorder for recording data and other peripherals. The surface controller 340 processes data according to programmed instructions and responds to user commands entered through a suitable device, such as a keyboard or a touch screen. The controller 340 is preferably adapted to activate alarms 344 when certain unsafe or undesirable operating conditions occur.

The method of drilling wellbores with the system of the invention will now be described while referring to FIGS. 1A–3. For the purpose of this description, the drilling of the vertical hole sections, such as section 14 and other straight sections, such as sections 18 and 20 of FIG. 1A is also referred to as two-dimensional or "2D" holes. The drilling of the curved sections, such as section 16 of FIG. 1A and sections 34, 38, and 42 is referred to as three dimensional or "3D" drilling.

Referring to FIG. 1A, to form a vertical section, such as section 14 (FIG. 1A), the ribs 132 of the steering device 130 are adjusted to exert the same side force by each rib 132. However, the rib forces are preferably individually controlled to better maintain verticality. The ribs 162 of the second steering device 160 may also be adjusted in the same manner. The drilling is then performed by rotating the drill bit 150 by the drilling motor 140. If desired, the drill pipe 152 may also be rotated from the surface at any speed if the same force is applied to all the ribs or alternatively at relatively low speed if the ribs are individually controlled. The controller 230 determines from the inclination sensor measurements if the drill string 387 has deviated from the true vertical. The controller, in response to the extent of such deviation, adjusts the force vectors of one or more ribs of the steering devices 130 and/or 160 to cause the drill bit 150 to drill along the true vertical direction. This process continues until the drill bit 150 reaches the depth d1.

To initiate the drilling of the curved section 16, the drilling direction is changed to follow the curve with the radius R1. In one mode, a command signal is sent by the surface controller 340 to the downhole controller 230, which adjusts the force vectors of the ribs of one or both the steering devices 130 and 160 to cause the drill bit 150 to start drilling in the direction of the planned curve (path). The controller 230 continues to monitor the drilling direction from the inclination and navigation sensors in the drilling assembly 100 and in response thereto adjusts or manipulates the forces on the ribs 132 and/or 162 in a manner that causes the drill bit to drill along the curved section 16. The drilling of the 3-D section 16 is performed by the drilling motor 140. The drill string 387 is not rotated from the surface. In this mode, the drilling path 16 and algorithms respecting the adjustments of the rib force vectors are stored in the controller 230. In an alternative mode, the drilling direction and orientation measurements are telemetered to the surface and the surface controller 340 transmits the force vectors for the ribs, which are then set downhole. Thus, to drill a 3D section, the drilling is performed by the motor, while the rib force vectors are manipulated to cause the drill bit to drill along the curved section. The above described methods provide a self-controlled closed loop system for drilling both the 2D and 3D sections.

To drill an inclined section, such as section 18, the drilling may be accomplished in two different ways. In one method, the drill string is not rotated. The drilling is accomplished by manipulating the force on the ribs. Preferably both rib steering devices 130 and 160 are utilized. To drill the straight section 18, the force for the various ribs, depending upon the rib location in the wellbore, are calculated to account for the inclination and the gravity effect. The forces on the ribs are set to such predetermined values to drill the inclined section 18. Adjustments to the rib forces are made if the drilling deviates from the direction defined by the section 18. This may be done by transmitting command signals from the surface or according to the programs stored in the controller 230.

Alternatively, the drill bit rotation of the drilling motor is superimposed with the drill string rotation. The ribs of the steering device are kept at the same force. One or both steering devices 130 and 160 may be used. During the rotation of the drill string, the directional characteristics can be adjusted by the same adjustment of the radial displacement of the ribs or through the variation of the average force to the ribs, which is equivalent to a change of the stabilizer diameter. The use of both sets of the ribs enhances this capability and also allows a higher build-up rate. Rotating the drill string lowers the friction and provides better hole cleaning compared to the mode wherein the drill string is not rotated.

The force vectors for drilling a straight section in one mode of operation are computed at the surface. When the drill bit reaches the starting depth for such a section, the surface controller 340 sends command signals to the downhole controller 230, which sets all the ribs of the desired steering device to a predetermined force value. The drilling system then maintains the force vectors at the predetermined value. If the inclination of the drilling assembly differs from that of the desired inclination, the downhole controller adjusts the force vectors to cause the drilling to occur along the desired direction. Instead, command signals may be sent from the surface to adjust the force vectors. Horizontal sections, such as section 20, are drilled in the same manner as the straight inclined sections. The curved sections, such as section 38, are drilled in the 3D manner described earlier.

Thus, the present invention provides a drilling system which can perform any directional drilling job from drilling a truly vertical hole, departing from the vertical hole to drill a curved hole and then a straight inclined and/or horizontal section. The curved section can be build-up or drop. The system includes a full directional sensor package and a control unit along with control models or algorithms. These algorithms include downhole adjustable build-up rates needed and the automated generation and maintenance of the force vectors. This eliminates the need for tedious manual weight-on-bit and tool face control commonly used. The true navigation becomes possible with the integration of gyro systems. This automated system substantially reduces the manual intervention, leaving the need to only supervise the drilling process.

The system of the present invention which utilizes the motor with the ribs that automatically adjusts side forces and the steering direction.closes the gap that exists between the conventional steerable motors with a fixed bend and the steering-while-rotating systems. Because the system of the present invention allows fine tuning the directional capability while drilling, and because of no need for time consuming tool face orientations, such systems often have significant benefits over the steerable motor systems. The systems of the present invention result in faster drilling and can reach targets in greater lateral.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A drill string for drilling wellbores, comprising:

(a) a rotatable tubular member conveyable from a surface location into the wellbore; and (b) a drilling assembly coupled at a first upper end to the tubular member, said drilling assembly comprising;

(i) a drill bit at a second bottom end of the drilling assembly;

(ii) a drilling motor uphole of the drill bit for rotating the drill bit;

(iii) a first set of ribs containing a plurality of ribs arranged around a section of the drilling assembly, said first set of ribs rotating at the same rotational rate as the tubular member in the wellbore when said rotatable tubular member rotates, each rib in said first set extending radially outward from the drilling assembly to apply force to the wellbore, upon the application of power thereto;

(iv) a power unit supplying power to the ribs; and (v) a controller selectively causing the ribs to apply different forces to the wellbore during drilling of a first section of the wellbore and to apply substantially the same force to each of the ribs in said first set of ribs during drilling of a second section of the wellbore.

2. The drill string according to claim 1 further comprising a second set of ribs containing a second plurality of ribs axially spaced apart from the first set of ribs and arranged around a second section of the drilling assembly, said second set of ribs rotating at the same rotational rate as the tubular member in the wellbore when said rotatable tubular member rotates, each rib in said second set of ribs extending radially outward from the drilling assembly to apply force to the wellbore inside, upon the application of power thereto.

3. The drill string according to claim 1 further comprising a sensor for providing measurements indicative of at least one parameter of interest selected from a group consisting of:

(i) inclination of the drilling assembly;

(ii) inclination of the borehole; and (iii) position of the ribs relative to borehole high side.

4. The drill string according to claim 1 further comprising a navigation sensor providing measurements of the direction of the drill bit during the drilling of the wellbore.

5. A method of drilling a wellbore having a curved section and a straight section, said method comprising:

a. conveying a drilling assembly in said wellbore by a rotatable tubular member, said drilling assembly including a drill bit at an end thereof that is rotatable by a drilling motor carried by the drilling assembly and a first set of ribs, said first set of ribs rotating at the same rotational rate as the tubular member in the wellbore when said rotatable tubular member rotates, with each rib being independently radially extendable to exert force on the wellbore inside;

b. drilling the curved section of the wellbore by rotating the drill bit only by the drilling motor and by applying different force on the wellbore inside by each said rib in said first set of ribs; and c. drilling the straight section of the wellbore by rotating the drill bit by the drilling motor and by maintaining substantially the same force on each rib in said first set of ribs.

6. The method of claim 5 further comprising providing a second set of ribs containing a plurality of independently controllable ribs which are axially spaced apart from said first set of ribs, said second set of ribs rotating at the same rotational rate as the tubular member in the wellbore when said rotatable tubular member rotates.

7. The method of claim 6 further comprising setting the ribs in said second set to exert the same forces on the wellbore during drilling of the straight section.

8. The method of claim 5, further comprising rotating the tubular member during the drilling of the straight section of the wellbore.

9. The method of claim 5 further comprising measuring inclination of one of (i) the drilling assembly or (ii) said wellbore.

10. The method of claim 5 further comprising drilling said wellbore along a predetermined well path.

11. The method of claim 5 further comprising determining a parameter indicative of direction of drilling of said wellbore.

12. The method of claim 11 further comprising altering drilling direction of said wellbore if said parameter is outside a predetermined limit.

13. The method of claim 12 wherein altering said drilling direction includes altering force applied by at least one rib in said first set of ribs.

14. An apparatus for drilling a wellbore having at least one straight section and at least one curved section , comprising:

(a) a rotatable tubular member conveyable from a surface location into the wellbore; and (b) a drilling assembly coupled at a first (upper) end of the drilling assembly to the tubular member, said drilling assembly comprising;

(i) a drill bit at a second (bottom) end of the drilling assembly;

(ii) a drilling motor uphole of the drill bit for rotating the drill bit;

(iii) a first set of ribs arranged around a section of the drilling assembly, said first set of ribs rotating at the same rotational rate as the tubular member in the wellbore when said rotatable tubular member rotates, each rib in said first set of ribs adapted to independently extend radially outward from the drilling assembly to apply force to the wellbore, upon the application of power to each rib in first set;

(iv) a power unit for supplying power to each rib in the first set; and (c) a controller having an associated program containing wellbore profile parameters relating to the at least one straight section and the at least one curved section, the controller selectively causing the ribs in the first set to apply different amounts of forces to the wellbore during drilling of the at least one curved section of the wellbore, the controller further selecting a force to be applied to each rib in the first set of ribs for drilling the straight section and maintaining the force on each rib at substantially equal to its selected value during drilling of the at least one straight section of the wellbore.

15. The apparatus according to claim 14 further comprising a second set of ribs axially spaced apart from the first set of ribs and arranged around a second section of the drilling assembly, said second set of ribs rotating at the same rotational rate as the tubular member in the wellbore when said rotatable tubular member rotates, each rib in said second set of ribs extending radially outward from the drilling assembly to apply force to the wellbore, upon the application of power to each rib in the second set.

16. The apparatus according to claim 15, wherein the controller further selects a force to be applied to each rib in the first set of ribs for drilling the straight section and maintains the force on each rib at substantially equal to its selected value during drilling of the at least one straight section of the wellbore.

17. The apparatus according to claim 14 further comprising a sensor for providing measurements indicative of at least one parameter of interest.

18. The apparatus according to claim 17 wherein the at least one parameter is selected from a group consisting of:

(i) inclination of the drilling assembly; and (ii) inclination of the borehole; the apparatus further comprising a sensor providing a signal indicative of the position of the ribs relative to wellbore high side.

19. The apparatus according to claims 18, wherein the controller causes the ribs in the first set of ribs to apply the different amounts of forces in response to the value of the selected parameter of interest.

20. The apparatus according to claim 14 further comprising a navigation sensor providing measurements of the direction of the drill bit during the drilling of the wellbore.

21. The apparatus according to claim 14, wherein the controller includes a microprocessor and memory for storing at least a portion of the program.

22. The apparatus according to claim 14 further comprising a telemetry unit for providing two-way data communication between the controller and a surface control unit.

23. The apparatus according to claim 22, wherein the controller further controls the amounts of forces applied by the ribs in the first set in response to signals received from the surface control unit.

24. The apparatus according to claim 14, wherein the program includes parameters of a predetermined wellbore path to be drilled.

25. The apparatus according to claim 24, wherein the controller adjusts the amounts of the forces applied by the ribs in the first set on the wellbore as a function of deviation of the actual drilling path of the wellbore from the predetermined wellbore path.

26. A method of drilling a wellbore having a curved section and a straight section, said method comprising:

(a) conveying a drilling assembly in said wellbore by a rotatable tubular member, said drilling assembly including a drill bit at an end thereof that is rotatable by a drilling motor carried by the drilling assembly and a first set of ribs, said first set of ribs rotating at the same rotational rate as the tubular member in the wellbore when said rotatable tubular member rotates, with each rib being independently radially extendable to exert force on the wellbore inside;

(b) drilling the curved section of the wellbore by rotating the drill bit only by the drilling motor and by applying a different force on the wellbore inside by each said rib in said first set of ribs; and (c) drilling the straight section of the wellbore by selecting a force to be applied to each said rib in said first set of ribs, rotating the drill bit by the drilling motor, and maintaining the force on each rib at substantially equal to its selected value;

wherein the force on each rib during drilling of the curved section and the straight section is determined at least in part upon a desired wellbore profile stored in a controller on the drilling assembly.

27. The method of claim 26 further comprising providing a second set of ribs containing a plurality of independently controllable ribs which are axially spaced apart from said first set of ribs, said second set of ribs rotating at the same rotational rate as the tubular member in the wellbore when said rotatable tubular member rotates.

28. The method of claim 27 further comprising selecting a force to be applied to each said rib in said second set of ribs, rotating the drill bit by the drilling motor, and maintaining the force on each rib in the second set of ribs at substantially equal to its selected value during the drilling of the straight section.

29. The method of claim 26, further comprising rotating the tubular member during the drilling of a straight portion of the wellbore.

30. The method of claims 26 further comprising measuring inclination of one of (i) drilling assembly or (ii) said wellbore.

31. The method of claim 26 further comprising drilling said wellbore along a predetermined well path.

32. The method of claims 26 further comprising determining a parameter indicative of direction of drilling of said wellbore.

33. The method of claim 32 further comprising altering drilling direction of said wellbore if said parameter is outside a predetermined limit.

34. The method of claims 26, wherein altering said drilling direction includes altering force applied by at least one rib in said first set of ribs.

* * * * *